US005954234A

United States Patent [19]

Connan et al.

[11] Patent Number: 5,954,234

[45] Date of Patent: Sep. 21, 1999

[54] UNIFORM DISPENSING MULTICHAMBER TUBULAR CONTAINERS

[75] Inventors: Patrick Andre Connan, Lebanon; Robert Mack, Flemington; Ramon Armando Mejia Mustafa, Hillsborough, all of N.J.

[73] Assignee: Colgate-Palmolive Company, New York, N.Y.

[21] Appl. No.: 09/157,216

[22] Filed: Feb. 12, 1998

Related U.S. Application Data

[63] Continuation-in-part of application No. 08/758,986, Dec. 2, 1996, abandoned, which is a continuation-in-part of application No. 08/659,734, Jun. 6, 1996.

[51] Int. Cl.[6] ..... B65D 35/22

[52] U.S. Cl. ..... 222/94

[58] Field of Search ..... 222/92, 94, 107, 222/129, 132

[56] References Cited

U.S. PATENT DOCUMENTS

| | | | |
|---|---|---|---|
| 1,894,115 | 1/1933 | Murphy | 222/94 |
| 2,517,027 | 8/1950 | Rado | 222/94 |
| 3,506,157 | 4/1970 | Dukess | 222/94 |
| 3,788,520 | 1/1974 | Dukess | 222/94 |
| 4,089,437 | 5/1978 | Chutter et al. | 222/94 |
| 4,687,663 | 8/1987 | Schaeffer | 222/94 X |
| 4,964,539 | 10/1990 | Mueller | 222/94 X |
| 5,076,464 | 12/1991 | Simon | 222/94 X |
| 5,244,120 | 9/1993 | O'Meara | 222/94 |
| 5,269,441 | 12/1993 | O'Meara | 222/94 |

*Primary Examiner*—Kevin P. Shaver
*Attorney, Agent, or Firm*—Michael McGreal

[57] ABSTRACT

A multichamber container must have certain characteristics in order to uniformly dispense the contents of each chamber from the container. The outer wall of the container and the inner divider web walls must have certain characteristics. The inner divider web walls must be highly flexible while the outer container wall must be less flexible. The Deflective Force for the outer wall must be greater than the Deflective Force for the web walls. In addition, to alleviate the problem of suckback of air into the container chambers, the outer wall should exhibit a specific Retention Index. This is a measure of the outer wall to remain deflected after the removal of the deflecting force. The inner divider web wall will have a lower Retention Index than the outer wall. By the proper selection of outer wall and web walls, there can be uniform dispensing from the dispenser. The Stiffness of the outer wall also should be less than the Stiffness for the inner web divider walls. This can be accomplished by the choice of films and the thickness of the outer wall film and the inner divider wall film.

20 Claims, 2 Drawing Sheets

UNIFORM DISPENSING MULTICHAMBER TUBULAR CONTAINERS

This application is a continuation-in-part of pending U.S. application Ser. No. 08/758,986 filed Dec. 2, 1996, now abandoned, which is a continuation-in-part of U.S. Ser. No. 08/659,734 filed Jun. 6, 1996.

FIELD OF THE INVENTION

This invention relates to multichamber tubular containers for uniformly dispensing a plurality of viscous products. More particularly, this invention relates to the structure for a tubular container for the uniform dispensing of contained products.

BACKGROUND OF THE INVENTION

Most viscous materials such as lotions, dentifrices, glues, caulks and other products are stored in and dispensed from single chamber tubular containers. Since only one substance is being dispensed, there is no problem concerning the uniformity of the dispensing. In addition, there is no problem with regard to the suckback of air into the tubular container to replace the product that has been dispensed. However, the uniformity of dispensing is a problem with regard to multichamber-chamber tubular containers. In most instances, it is desired to dispense these products in a particular uniform ratio. This can be in equal amounts or in essentially any ratio of one to the other. The objective is to have this uniform dispensing from the first dispensing through to the last dispensing, regardless of how the tubular container is pressurized and the product is dispensed. Further, after the products are dispensed, there preferably should not be a suckback of air down into the tubular container to replace the products that have been dispensed. There can be some suckback of the products from the tip of the dispensing nozzle further down into the nozzle. However, the suckback should not draw air clown into the chambers of the tubular container.

If air is drawn down into the chambers of the tubular container, bubbles of varied number and sizes will be formed within the chambers. Then, during subsequent dispensing product alone may be dispensed from one or more chambers and air and product from one or more other chambers. The net result will be a non-uniform dispensing of the components.

It also is important that the tubular container have a structure whereby the position of the application of the dispensing force will not materially affect the uniformity of the dispensing. That is, whether the dispensing force is parallel or perpendicular to a tubular container chamber dividing wall, the amount of each product dispensed will be uniform. Likewise, the amount of each product dispensed should be uniform regardless of whether the tubular container is squeezed using two, three or four fingers or the full hand.

There is considerable prior art in the area of multichamber tubular containers. These generally are of two different categories. A first category consists of tubular containers where one chamber is surrounded by another chamber. These are sometimes called "tube in a tube" containers. It is difficult to uniformly dispense products form this type of tubular container. This is the case since the dispensing pressure is applied to only one chamber and there are narrow channels for dispensing each product. A second category consists of side by side chambers. This is a type that is more amenable to uniform dispensing and the present invention is directed to this type of tubular container. The present invention is directed to characteristics of this type of tubular container for the uniform dispensing of products of related rheologies.

The general prior art is exemplified by a tube-in-a-tube structure as illustrated in U.S. Pat. No. 4,211,341 which discloses a tubular container having two concentric chambers where there is a large amount of one substance and a lesser amount of another substance. U.S. Pat. No. 2,939,610 and U.S. Pat. No. 2,959,327 disclose other structures for a tube-in-a-tube type of multichamber container. A side-by-side type of arrangement of a multichamber tubular container is shown in U.S. Pat. Nos. 1,894,115; 2,944,705; 4,089,437 and 5,244,120. Each of these patents discloses a tubular container where two substances are separately stored. They come into contact only after dispensing. Each of these patents discloses a structure of an outer wall and an inner web. In addition, in U.S. Pat. No. 4,089,437, there is disclosed the use of a pressure responsive moveable septum as a part of the web. This consists of a part of the divider web adjacent the dispensing end of the tubular container having a corrugated or bulbous structure. The objective is to have this septum readily flex to distribute the applied dispensing forces to the outer wall equally to the substances in each chamber.

The problem of uniform dispensing of substances from multichamber tubular containers is recognized in U.S. Pat. No. 4,089,437. The objective is to have uniform dispensing of contained substances regardless of how the tubular container is squeezed during a dispensing. However, this problem is not effectively solved in U.S. Pat. No. 4,089,437.

The objective is that regardless of whether the tubular container is squeezed from the bottom or the top, or parallel or perpendicular to the divider web, there should be a uniform dispensing of the container substances. In addition, the dispensing should be uniform from the first dose to the last dose. This is not effectively accomplished in U.S. Pat. No. 4,089,437. The use of a pressure responsive septum does not solve the problem.

BRIEF SUMMARY OF THE INVENTION

The problem that is solved is the uniform dispensing of a plurality of products from a tubular container that has a plurality of chambers. The contained products have related rheologies. They also must be used in a certain ratio. Consequently, regardless of the application of pressure onto the tubular container outer wall, the dispensing of the substances should be substantially uniform.

This is accomplished by the use of a tubular container where the exterior walls have a given Deflective Force and Stiffness and the inner divider wall webs have another Deflective Force and Stiffness. Further, the filled container should have a certain Shape Retention Index. The theoretical objective is to reduce the effect of the divider wall webs to essentially zero. That is, the effect of the divider wall webs is minimal. On the other hand, the exterior wall of the tubular container should be of a stiffness to distribute the applied dispensing force over a wide area to promote the more uniform movement of the contained products to the dispensing outlet. However, the exterior wall should be of the collapsible type rather than the deformable type. A collapsible type is a wall which substantially retains its collapsed shape upon the removal of an applied dispensing force. There is a minimal suckback of air into the chambers of the tubular container with this type of container wall. A deformable type of tubular container wall is one where upon the release of the applied dispensing force, the tubular container will substantially regain its prior shape. In this type of container, air is drawn in to replace the dispensed products.

The tubular containers of this invention should be of the collapsible type, have a Deflective Force of 500 grams to about 1500 grams to flex the tubular container sidewall about 9 mm, preferably less than about 1000 grams and a Shape Retention Index of less than about 30 percent, preferably less than 15 percent and most preferably less than about 10 percent. The sidewall thickness should be about 0.2 mm to about 0.8 mm, and preferably about 0.2 mm to about 0.6 mm. The web interior dividing wall should have a Deflective Force of about 20 grams to about 120 grams to flex the web wall about 9 mm, preferably less than about 75 grams, a thickness of about 0.02 mm to about 0.15 mm, and preferably about 0.05 mm to about 0.13 mm and a Shape Retention Index of less than about 20 percent, preferably less than about 10 percent, and most preferably about 0 to 5 percent. In addition, the lateral dimension of the web wall for an equal volume dual chamber container should be more than the diameter and for a circular container up to about ½Π(d) of the dimension spanned by the divider web wall where d is the diameter of the tubular container at the point of the divider web wall. That is, up to ½ the circumference of a circular tubular container.

In addition, the web divider wall should have a stiffness of about 0.1 N/cm to about 2.5 N/cm using ASTM D2923-96 modified for use on an Instron 4301. Preferably, the thickness of the web divider wall has a stiffness of about 0.2 N/cm to about 2 N/cm. The stiffness of the exterior wall should be about 5 N/cm to about 100 N/cm, and preferably about 10 N/cm to about 75 N/cm. The Stiffness Test further delineates the specification that the outer wall an the web divider wall should meet. N/cm is Newtons per centimeter. These Stiffness values are an average of the machine direciton and transverse direction measurements.

A dual multichamber tubular container having these characteristics will provide for the uniform dispensing of products having related rheologies. There will be a substantially uniform distribution of dispensing force into the tubular chamber surface while substantially preventing the suckback of air into the tubular container.

BRIEF DESCRIPTION OF THE DRAWINGS

FIG. 5(*b*) is a cross-sectional view of an elliptical-shaped tubular container with the divider web wall along the minor axis.

DETAILED DESCRIPTION OF THE DRAWINGS

Figure 1:
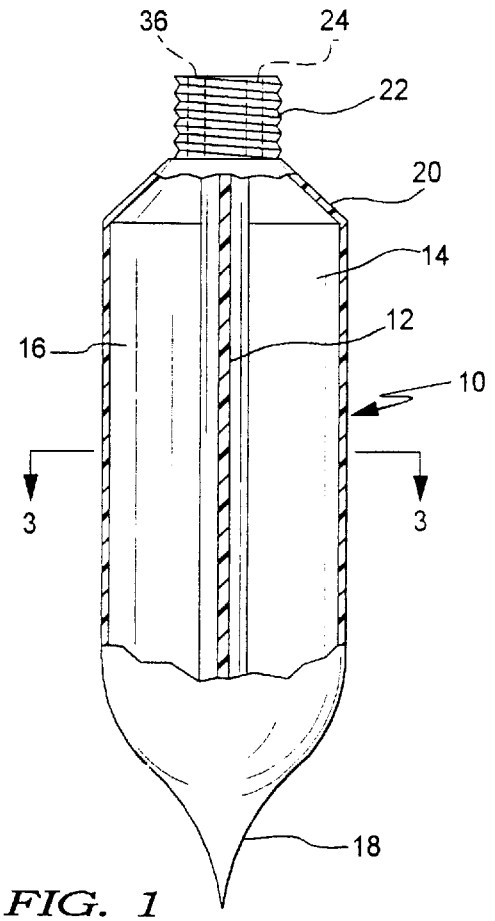
FIG. 1 is an elevational view in section of a dual chamber tubular container.

The multichamber tubular container will be discussed in more detail with reference to the drawings. FIG. 1 is an elevational view of a dual chamber tubular container having a lower crimp sea.

Tubular container 10 has outer wall 20 which is crimp sealed at the lower end 18 and has a threaded neck finish 22 at the other end. Inner divider web wall 12 divides the tubular chamber into chambers 14 and 16. These chambers communicate with the exterior through apertures 24 and 26 respectively in the neck. The divider web wall will have a dimension greater than the diameter of the tubular container which is better shown in FIG. 3. The divider web wall 12 can be of essentially any shape and the volumes of chambers 14 and 16 can vary in accordance with the fill amounts in each chamber.

Figure 3:
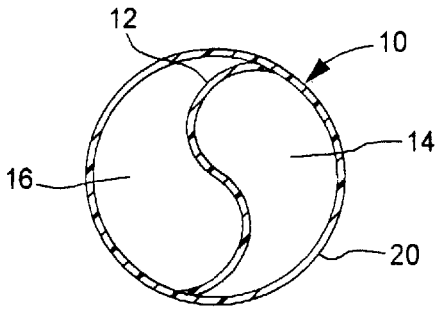
FIG. 3 is a cross-sectional view of the tubular container of FIG. 1 along line 3—3.

FIG. 3 is a cross-sectional view of the tubular container of FIG. 1. This view shows center web wall 12 which extends from the crimp sea 18 through to the exit apertures 24 and 26. The divider web wall 12 will have a lateral dimension up to about one-half the circumference of the tubular container which, for a circular tubular container as shown, is expressed as ½Π(d) where d is the diameter of the tubular container. A lateral dimension greater than the diameter of the tubular container provides for greater divider web wall flexibility and also will permit the web wall being located fully transversely in the crimp seal if this is the desired structure.

Figure 2:
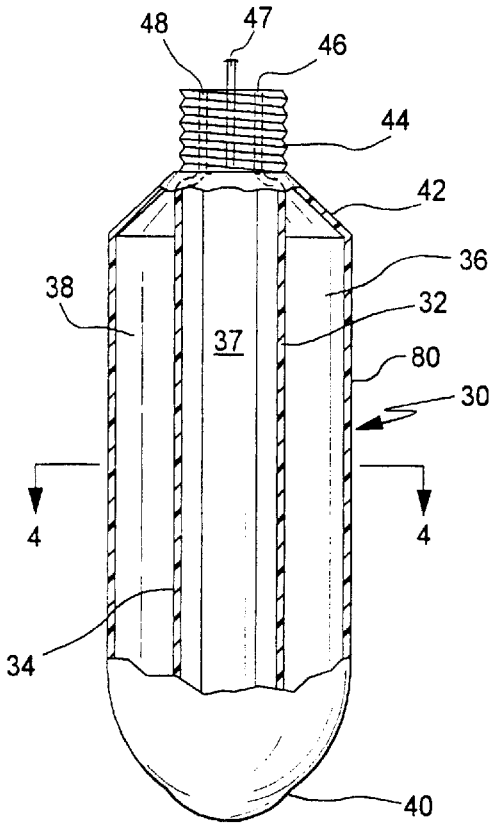
FIG. 2 is an elevational view in section of a three chamber tubular container.
Figure 4:
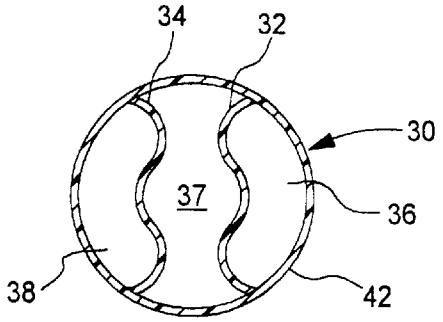
FIG. 4 is a cross-sectional view of the tubular container of FIG. 2 along line 4—4.

In FIG. 2 there is described a three chamber multichamber tubular container 30. This container has a continuous bottom portion with no crimp seal. This tubular container has an outer wall 42, a bottom portion 40 on one end and a threaded neck 44 on the other end. This tubular container has web walls 32 and 34 which divide the tubular container into chambers 36, 37 and 38. These chambers communicate with the exterior of the tubular container through apertures 46, 47 and 48, respectively. The structure of the divider web walls and the chambers is further described in FIG. 4. The flexible divider web walls and the various chambers are further described in this figure. This cross-sectional view shows the divider web walls and the three chambers in more detail. These divider web walls can be of different lateral dimensions and the chambers do not have to be of equal volumes.

Figure 5A:
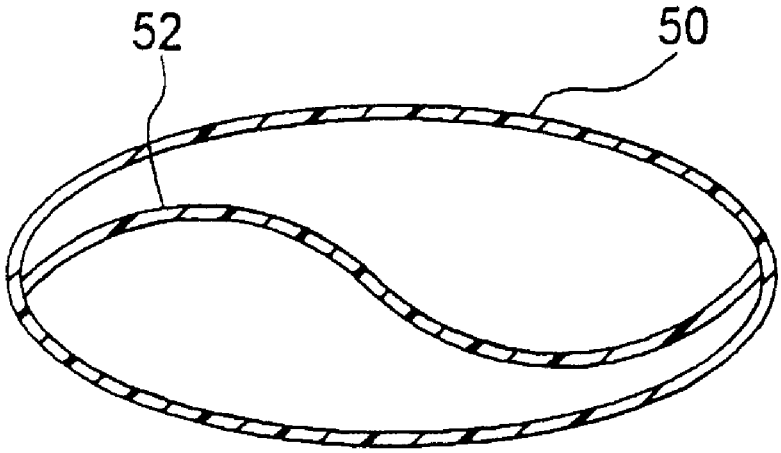
FIG. 5(*a*) is a cross-sectional view of an elliptical-shaped tubular container with the divider web wall along the major axis.
Figure 5B:
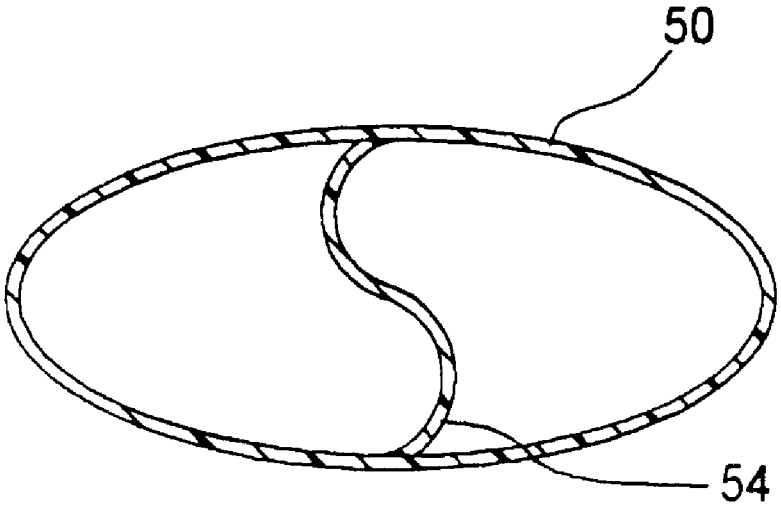

FIGS. 5(*a*) and 5(*b*) illustrate that the tubular container is not restricted to a circular tubular container. In FIG. 5(*a*), inner divider web wall 52 is shown as across the major axis of elliptical container 50 while in FIG. 5(*b*), it is shown across the minor axis. Each of these tubular containers could have more than one inner divider web wall and more than two chambers. Also, many other shapes are feasible for the tubular containers.

Besides this basic structure, the sidewalls of the tubular containers and the web walls should have particular characteristics.

The sidewall should have a thickness of about 0.2 mm to about 0.8 mm and preferably about 0.2 to about 0.6 mm and a Deflective Force of about 500 grams to about 1500 grams to move the sidewall about 9 mm and preferably less than about 1000 grams. The Stiffness should be about 5 N/cm to about 100 N/cm, and preferably about 10 N/cm to about 75 N/cm. The Shape Retention Index should be less than about than about 30 percent and preferably less than 15 percent, and most preferably less than about 10 percent. The sidewalls must be collapsible rather than deformable. That is when the sidewall is deformed such as by the application of a dispensing force, it must substantially retain this deformed shape. The Shape Retention Index to a large degree determines the collapsible properties of a tubular container sidewall.

The inner divider web wall should have a thickness of about 0.02 mm to about 0.15 mm, and preferably about 0.05 mm to about 0.13 mm, and a Shape Retention Index of less than about 20 percent, preferably less than 10 percent, and most preferably about 0 to 5 percent. The Stiffness should be about 0.1 N/cm to about 2.5 N/cm, and preferably about 0.2 N/cm to about 2 N/cm. The Deflective force should be about 20 grams to about 120 grams to flex the divider web wall 9 mm, and preferably less than about 75 grams. The divider web wall must be easily and readily deflected. Preferably, it should move as readily as the products within the chambers of the dual chamber tubular container will flow. When the divider web wall will move as readily as the materials will flow the web wall essentially becomes transparent to the contained products and will not adversely affect the flow of each of the products from the dispensing end of the tubular container.

The Deflective Force is the maximum force expressed in grams required to deflect a plastic web bent in the form of an inverted U by a shaped adapter fitted to a compression tester such as an Instron® Tensile Testing Machine, the force being applied axially downward on the arcuate section of the U-shaped web at a rate of 30.5 cm per minute.

The adapter installed on the Instron® Machine is 14 cm high and consists of a 0.64 cm thick stainless steel block, 2.54 cm square, with a 0.32 cm diameter stainless steel wire curving downwardly to an open rectangular section 12.7 cm wide and 6.4 cm high. The adapter is fitted into the jaws of the Instron® Machine and is moved downwardly to contact and deflect the surface of the web being tested.

The plastic web being tested is held in a specimen holder consisting of a stainless steel base 0.32 cm in thickness having a slot 2.54 cm wide 10.2 cm long and 5 cm high. A lower mount for this base 2.54 cm in length mounts the base to the work platform of the Instron® Machine. A specimen brace fits into the base to hold the plastic web in the base the brace consisting of a channel 10.2 cm in length 2.5 cm wide and 5 cm high having a wall thickness of 1.6 cm. The specimen brace holds the web in the base in an inverted U-shape.

When making a measurement of Deflective Force, six plastic web specimens cut in the machine direction and six plastic web specimens cut in the cross direction, each specimen being 10.2 cm×10.2 cm, are tested. Each specimen being tested is placed in the specimen holder and held in place by the brace so that it forms an inverted U shape. No specimen sample is reused. The specimen holder with the sample is placed in the Instron® Machine 4301 and the adapter lowered to just above the specimen and then lowered at the rate of 30.5 cm per minute to effect a web deflection of 9 mm. The force in grams to deflect the web in this manner is recorded as the Deflective Force.

The Stiffness is tested using ASTM Method D2923-96, modified for use on an Instron 4301. The Instron is attached to a Compaq computer which provides a Stiffness value in Newtons and a plot of the same. The specimen is 10.2 cm by 10.2 cm. The penetrator beam enters the plate at a rate of 30.5 cm/minute and to a depth of approximately 8 mm. The slot in the platform is 0.05 cm. Six samples of each film are tested. Preferably this is six samples of a test of the film in the machine direction and six samples of the film in the cross-direction with all of the values averaged together. The values for comparison are given in N/cm. The Instron provides values in Newtons. The Stiffness is calculated by the formula $S=(r/n)/W$ where r is the sum of the maximum reading for each sample, n is the number of samples and W is the width of the slot. The results are in Newtons per centimeter.

The Shape Retention Index is determined by forming a tube having a diameter of 40 mm and crimped sealed at one end. The tube is filled with the substance to be dispensed from the tube. The open tube is held in a fixture in an Instron Machine and contacted by the above described adapter. The adapter contacts the tube laterally across the tube at the longitudinal midpoint of the tube. Some contained substance is dispensed during the test. The distance of return upward movement of the wall divided by the downward distance to deflect the tube wall is the Shape Retention Index. The inner divider wall of the present multichamber tubular containers should have a Shape Retention Index of less than about 20 percent, preferably less than about 10 percent, and most preferably about 0 to 5 percent while the sidewall of these tubular containers should have a Shape Retention Index of less than about 30 percent, preferably less than about 15 percent and most preferably less than about 10 percent. The Shape Retention Index will depend to a degree on the materials of the sidewall and inner divider web wall and the thickness of the sidewall and the inner divider web wall.

The sidewalls and the inner divider web wall can be comprised of a single layer or multilayer laminate structure. The useful materials include polypropylene, polyethylene (high to low density), polybutadiene, ethylene vinyl alcohol, ethylene vinylacetate, vinylidene chloride, polyethylene terephthalate, polybutylene terephthalate, polyacrylonitile and laminate structures that use layers of these materials. In many instances the sidewall will be a laminate structure while the web wall will be a monolayer. It is preferred that the divider web wall be as thin as possible which makes a monolayer useful. However the divider web wall can be of a multilayer structure depending on the barrier properties desired for this wall.

The present invention can be modified as to sidewall and divider web wall materials and characteristics. However, any modifications which functionally produce the same tubular container are within the present invention.

What is claimed is:

1. A multichamber tubular container for the controlled dispensing from each chamber comprising an elongated tubular member closed at one end and having a dispensing means at another end, said tubular member defined by an outer wall and at least one inner divider wall, said outer wall having a thickness of about 0.2 mm to about 0.8 mm, a Retention Index of less than about 30 percent, and a Deflective Force of at least about 500 to 1500 grams to flex said outer wall about 9 mm, said at least one inner divider wall having a substantially uniform thickness of about 0.02 to about 0.15 mm and a Deflective Force of about 20 to about 120 grams to flex said inner divider wall about 9 mm and a Retention Index of less than about 20 percent.

2. A mnultichamber tubular container as in claim 1 wherein said outer wall has a thickness of about 0.2 mm to about 0.6 mm and a Retention Index of less than about 15 percent.

3. A multichamber tubular container as in claim 1 wherein said divider wall has a thickness of about 0.05 mm to about 0.13 mm and a Retention Index of about 0 to 5 percent.

4. A multichamber tubular container as in claim 1 wherein the ratio of the thickness of said inner divider wall to said outer wall is more than about 2 to 1.

5. A multichamber tubular container as in claim 4 wherein the ratio of the thickness of said inner divider wall to said outer wall is more than about 3 to 1.

6. A multichamber tubular container as in claim 1 wherein said outer wall is a multilayer laminate.

7. A multichamber tubular container as in claim 6 wherein said inner divider wall is a monolayer film.

8. A multichamber tubular container as in claim 6 wherein said inner divider wall is a multilayer film.

9. A multichamber tubular container as in claim 1 wherein said tubular member is closed at one end by a crimp seal.

10. A multichamber tubular container as in claim 1 wherein said outer wall has a Deflective Force of less than about 1000 grams.

11. A multichamber tubular container as in claim 10 wherein said inner divider wall has a Deflective Force of less than about 75 grams.

12. A multichamber tubular container for the controlled dispensing from each chamber comprising an elongated tubular member closed at one end and having a dispensing means at another end, said tubular member defined by an outer wall and at least one inner divider wall, said outer wall having a thickness of about 0.2 mm to about 0.8 mm, a Stiffness of about 5 N/cm to about 100 N/cm and a Deflective Force of at least about 500 to 1500 grams to flex said outer wall about 9 mm, said at least one inner divider wall having a substantially uniform thickness of about 0.02 to about 0.15 mm and a Deflective Force of about 20 to about 120 grams to flex said inner divider wall about 9 mm.

13. A multichamber tubular container as in claim 12 wherein said outer wall has a thickness of about 0.2 mm to about 0.6 mm and a Stiffness of about 10 N/cm to about 75 N/cm.

14. A multichamber tubular container as in claim 12 wherein said inner divider wall has a thickness of about 0.05 mm to about 0.13 mm and a Stiffness of about 0.1 N/cm to about 2.5 N/cm.

15. A multichamber tubular container as in claim 12 wherein the ratio of the thickness of said inner divider wall to said outer wall is more than about 2 to 1.

16. A multichamber tubular container as in claim 12 wherein the ratio of the thickness of said inner divider wall to said outer wall is more than about 3 to 1.

17. A multichamber tubular container for the controlled dispensing from each chamber comprising an elongated tubular member closed at one end and having a dispensing means at another end, said tubular member defined by an outer wall and at least one inner divider wall, said outer wall having a thickness of about 0.2 mm to about 0.8 mm, a Retention Index of less than about 30 percent, and a Stiffness of about 5 N/cm to about 100 N/cm to flex said outer wall about 9 mm, said at least one inner divider wall having a substantially uniform thickness of about 0.02 to about 0.15 mm and a Stiffness of about 0.1 N/cm to about 2.5 N/cm and a Retention Index of less than about 20 percent.

18. A multichamber tubular container as in claim 17 wherein said outer wall has a thickness of about 0.2 mm to about 0.6 mm and a Stiffness of about 10 N/cm to about 75 N/cm.

19. A multichamber tubular container as in claim 17 wherein said inner divider wall has a thickness of about 0.05 mm to about 0.13 mm and a Stiffness of about 0.2 N/cm to about 2 N/cm.

20. A multichamber tubular container as in claim 17 wherein the ratio of the thickness of said inner divider wall to said outer wall is more than about 2 to 1.

* * * * *